US008051538B2

(12) United States Patent
Hsieh

(10) Patent No.: US 8,051,538 B2
(45) Date of Patent: Nov. 8, 2011

(54) HANDLE WITH ASYMMETRICAL CONFIGURATION

(76) Inventor: Chih-Ching Hsieh, Taichung Hsien (TW)

( * ) Notice: Subject to any disclaimer, the term of this patent is extended or adjusted under 35 U.S.C. 154(b) by 255 days.

(21) Appl. No.: 12/434,418

(22) Filed: May 1, 2009

(65) Prior Publication Data

US 2010/0192733 A1 Aug. 5, 2010

Related U.S. Application Data

(63) Continuation-in-part of application No. 11/389,191, filed on Mar. 27, 2006, now abandoned.

(51) Int. Cl.
*B25G 1/10* (2006.01)

(52) U.S. Cl. ..... 16/436; 16/431; 16/DIG. 12; 16/430

(58) Field of Classification Search ..... 16/430, 16/436, DIG. 12, DIG. 19, 431; 81/177.1, 81/177.4, 177.8, 489; D8/82–87, 107
See application file for complete search history.

(56) References Cited

U.S. PATENT DOCUMENTS

| | | | | |
|---|---|---|---|---|
| D154,326 | S | | 6/1949 | Roysher |
| 3,173,462 | A | | 3/1965 | Koeppel |
| 3,586,080 | A | | 6/1971 | Slany |
| D256,546 | S | | 8/1980 | Holland-Letz |
| D256,882 | S | | 9/1980 | Jansson |
| 4,739,536 | A | | 4/1988 | Bandera et al. |
| D328,700 | S | | 8/1992 | Steiger |
| 5,390,572 | A | | 2/1995 | Gakhar et al. |
| D414,096 | S | * | 9/1999 | Chapin et al. ..... D8/83 |
| D419,846 | S | | 2/2000 | Hasan |
| 6,148,701 | A | * | 11/2000 | Lee ..... 81/489 |
| RE37,190 | E | | 5/2001 | Stowell et al. |
| D454,477 | S | | 3/2002 | Lin |
| D461,385 | S | * | 8/2002 | Chen ..... D8/83 |
| D481,922 | S | | 11/2003 | Yu et al. |
| D487,690 | S | * | 3/2004 | Hu ..... D8/83 |
| D510,692 | S | | 10/2005 | Walker |
| D515,389 | S | | 2/2006 | Hsu |
| D553,464 | S | | 10/2007 | Rinner |
| 7,293,331 | B2 | * | 11/2007 | Lawless ..... 16/430 |

FOREIGN PATENT DOCUMENTS

DE 2061880 B * 7/1974

* cited by examiner

*Primary Examiner* — Chuck Y. Mah
(74) *Attorney, Agent, or Firm* — Guice Patents PLLC

(57) ABSTRACT

The invention provides a handle of a hand tool. The handle has a grip section and a neck section. Multiple abutment regions are disposed on a circumference of the neck section for a user's thumb to press against the abutment regions. Multiple grip regions are disposed on a circumference of the grip section for the user's palm and other fingers to hold. The grip regions and the abutment regions are asymmetrically arranged, whereby different grip regions and different abutment regions of handle cooperate to provide many different holding ranges. Different users can choose their most suitable holding positions to hold the handle in accordance with the sizes of their hands.

17 Claims, 8 Drawing Sheets

HANDLE WITH ASYMMETRICAL CONFIGURATION

This application is a Continuation-in-Part of application Ser. No. 11/389,191, entitled HANDLE FOR HAND TOOL, filed on Mar. 27, 2006, now abandoned.

FIELD OF THE INVENTION

The present invention is related to a handle of a hand tool, and more particularly to a handle of a screwdriver, which provides different holding ranges for different users to easily hold the handle.

BACKGROUND OF THE INVENTION

The handle of a hand tool such as a screwdriver is for a user to hold and exert force onto the hand tool. Accordingly, the configuration of the handle determines the holding effect and force application effect of a user when operating the hand tool.

Different users have different sizes of palms and different lengths of fingers. The conventional handle is generally designed without taking into consideration that different users have different sizes of hands.

The conventional handle generally has a symmetrical configuration. U.S. Pat. No. 3,173,462 discloses a grip 12 of a screwdriver. The body portion of the grip 12 has six longitudinal grooves 22. Six small grooves 24 are formed on a periphery of a front end of the grip for a user to quickly rotate the tool by finger movement. The small grooves 24 on the front half of the grip and the longitudinal grooves 22 of the rear half of the grip have the same number to form a symmetrical configuration.

U.S. Design Pat. No. D510,692 discloses a grip having a body portion and a front neck portion. Four grip faces are disposed on the body portion and four abutment faces are disposed on the neck portion. The grip faces and abutment faces also form a symmetrical configuration.

U.S. Design Pat. No. D328,700 discloses a grip having a front half and a rear half, which are symmetrically arranged. As shown in FIGS. 1 to 6 of this Design Patent, four elongated wide grooves are disposed on a front half of the grip, while eight elongated narrow grooves are disposed on a rear half of the grip. As shown in FIGS. 7 to 12 of this Design Patent, three wider grooves are disposed on the front half of the grip, while six narrower grooves are disposed on the rear half of the grip. The front half and the rear half of the grip also form a symmetrical configuration.

As exemplified with said U.S. Design Pat. No. D510,692, a user's palm and four fingers together hold the body portion of the grip with the thumb pressing against an abutment face. Accordingly, the grip provides more force application points to achieve better holding effect. However, the grip has fixed size and is suitable only for a certain size of hand. To those users with larger hands or smaller hands, it is hard to firmly hold the grip. As the grip has a symmetrical configuration with fixed holding range, wherever a user holds the grip, that is, when a user turns the grip 90-degree clockwise or counterclockwise and then hold it with his/her hand, no matter where the user holds the grip, the holding range for the hand will be exactly the same with no difference. Therefore, the symmetrical grip is only adapted to common-size hands, while being unsuitable for otherwise sized hands.

In U.S. Design Pat. No. D328,700, there are four wide grooves disposed on the front half of the grip for a thumb to press against any of the wide grooves. In U.S. Design Pat. No. D510,692, there are four abutment faces disposed on the neck portion of the grip for a thumb to press against any of the abutment faces. However, in U.S. Pat. No. 3,173,462, there are six small grooves 24 disposed on the front end of the grip to define six protruding sections between the small grooves. The small grooves are not for the thumb to press against. This is because each small groove has a width too small for the thumb to contact. Instead, the thumb contacts the protruding section. When applying force to the grip to rotate the same, a user will not press his/her thumb against the front end of the grip. This is because in this case, the user's thumb will feel painful.

U.S. Pat. No. 3,586,080 discloses a handle 1 of a screwdriver. The handle 1 has a rear portion 3 on which three grip regions 10 are disposed. Eight small longitudinal grooves 6 are disposed on a circumference of a front end of the handle 1. The number of the small longitudinal grooves 6 of the front end is different from the number of the grip regions 10 of the rear portion 3. The small longitudinal grooves 6 and the grip regions 10 are such arranged as to form an asymmetrical configuration. However, the small longitudinal grooves 6 are not for the thumb to press against. This is because in the case that a user presses his/her thumb against the front end of the handle, the user's thumb will feel painful.

SUMMARY OF THE INVENTION

It is therefore a primary object of the present invention to provide a handle with asymmetrical configuration. The handle provides different holding ranges adapted to different sizes of hands, whereby different users can easily hold the handle to apply force thereto.

The handle of the present invention has a grip section and a neck section connected with a top end of the grip section. Multiple abutment regions are disposed on a circumference of the neck section for a user's thumb to press against the abutment regions. Multiple grip regions are disposed on a circumference of the grip section for the user's palm and other fingers to easily hold. The grip regions and the abutment regions are asymmetrically arranged, whereby different grip regions and different abutment regions of handle cooperate to provide many different holding ranges. Different users can choose their most suitable holding positions to hold the handle in accordance with the sizes of their hands. Accordingly, the users can more easily apply force onto the handle to operate the hand tool.

The present invention can be best understood through the following description and accompanying drawings wherein:

DETAILED DESCRIPTION OF THE PREFERRED EMBODIMENTS

Figure 1:
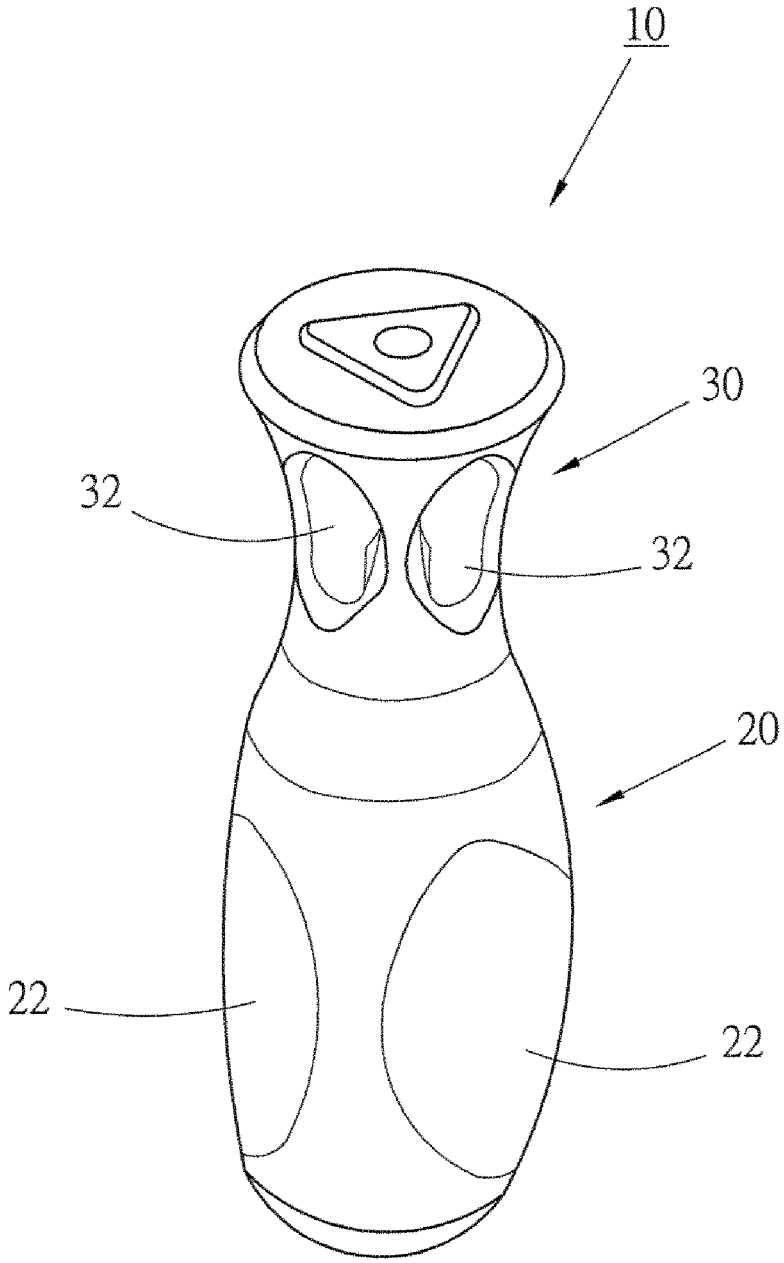
FIG. 1 is a perspective view of a first embodiment of the handle of the present invention.
Figure 2:
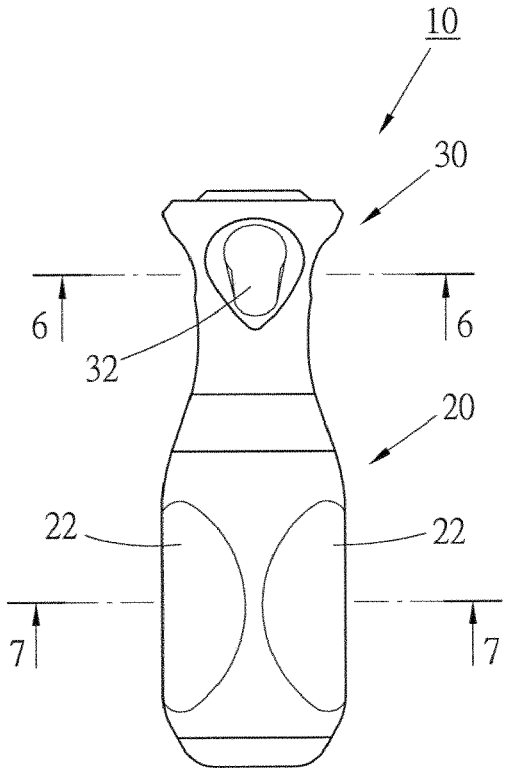
FIG. 2 is a side view of the first embodiment of the handle of the present invention.
Figure 3:
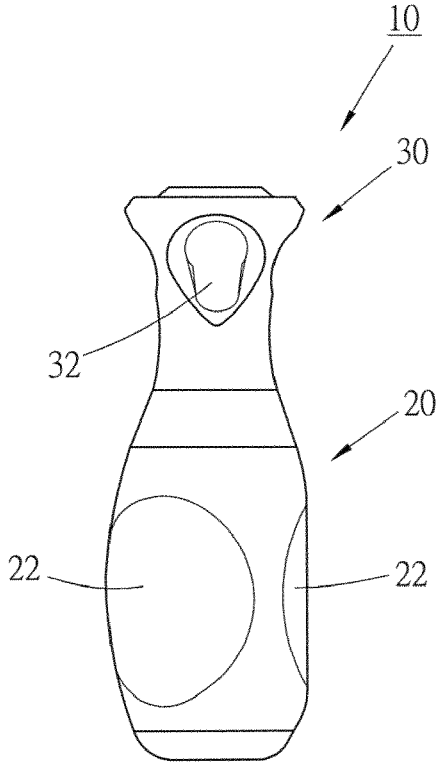
FIG. 3 is a side view of the first embodiment of the handle of the present invention, which is a 90-degree rotated view according to FIG. 2.

Please refer to FIGS. 1 to 3. According to a first embodiment, the handle 10 of the present invention has a grip section 20 and a neck section 30 connected with a top end of the grip section 20 and generally formed with a smaller outer diameter. The handle 10 is applicable to a hand tool such as a screwdriver for a user to hold and exert force thereon.

Figure 4:
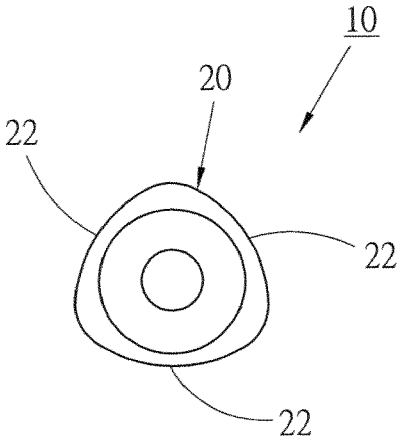
FIG. 4 is a bottom view according to FIG. 2.
Figure 5:
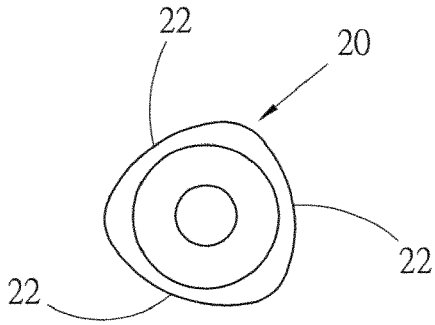
FIG. 5 is a bottom view according to FIG. 3.
Figure 7:
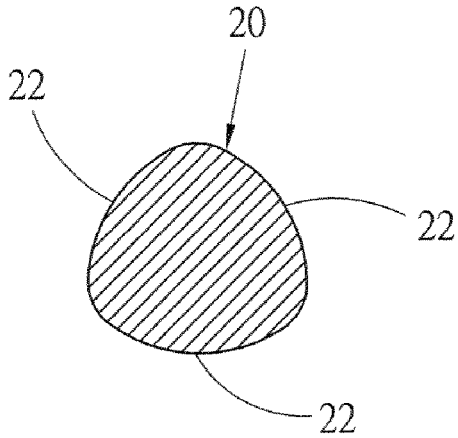
FIG. 7 is a sectional view taken along line 7-7 of FIG. 2.

Referring to FIGS. 4 and 5, an odd number of grip regions 22 is disposed on a circumference of the grip section 20 at equal intervals. For example, there are three or five grip regions 22. In this embodiment, the grip section has a substantially triangular cross-section to provide three grip regions 22 as shown in FIG. 7 for a user's palm to easily hold. The odd number of grip regions is adapted to the joints between the palm and fingers and meets human engineering requirements.

Figure 6:
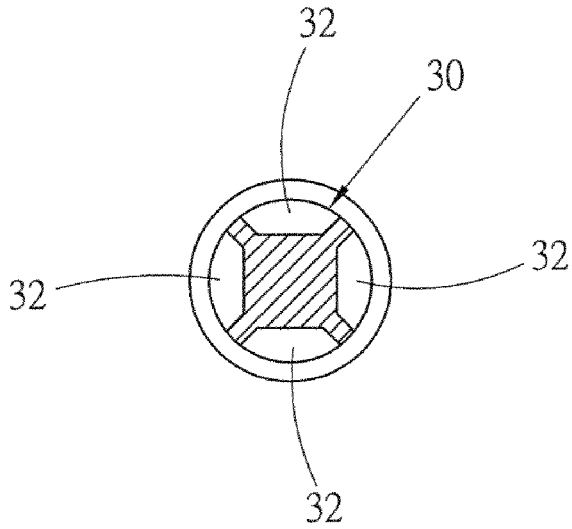
FIG. 6 is a sectional view taken along line 6-6 of FIG. 2.

An even number of abutment regions 32 is disposed on a circumference of the neck section 30. Each abutment region 32 is, but not limited to, a recess. In this embodiment, there are four abutment regions 32 disposed on the circumference of the neck section 30 at equal intervals as shown in FIG. 6, whereby a user thumb can press against and lean on the abutment regions 32 so as to more stably hold the handle in operation. Preferably, the abutment region 32 has a configuration such as oval configuration adapted to that of the thumb to facilitate location of the thumb.

Figure 9:
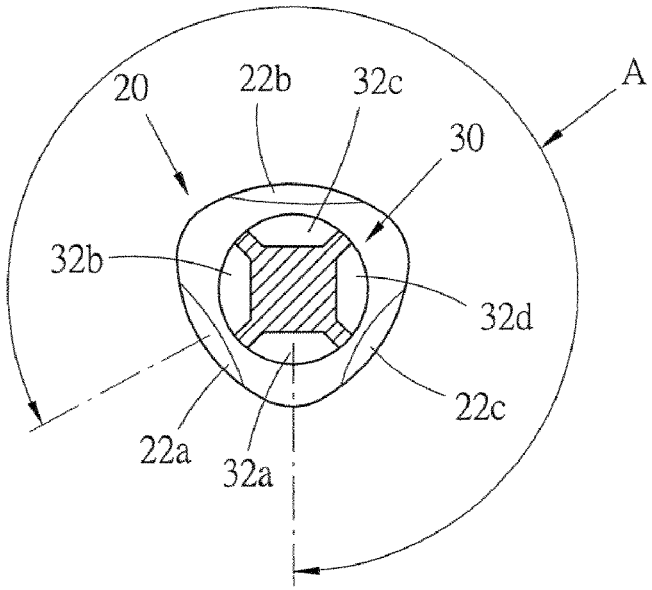
FIG. 9 is a sectional view taken along line 9-9 of FIG. 8, showing the holding range thereof.

According to the above arrangement, the grip regions 22 are arranged in an asymmetrical relationship with the abutment regions 32. That is, the grip regions 22 and the abutment regions 32 are irregularly arranged as shown in FIG. 9. The positions of the grip regions are misaligned from those of the abutment regions. Accordingly, different users with different sizes of hands can choose their most suitable positions to hold the handle.

Figure 8:
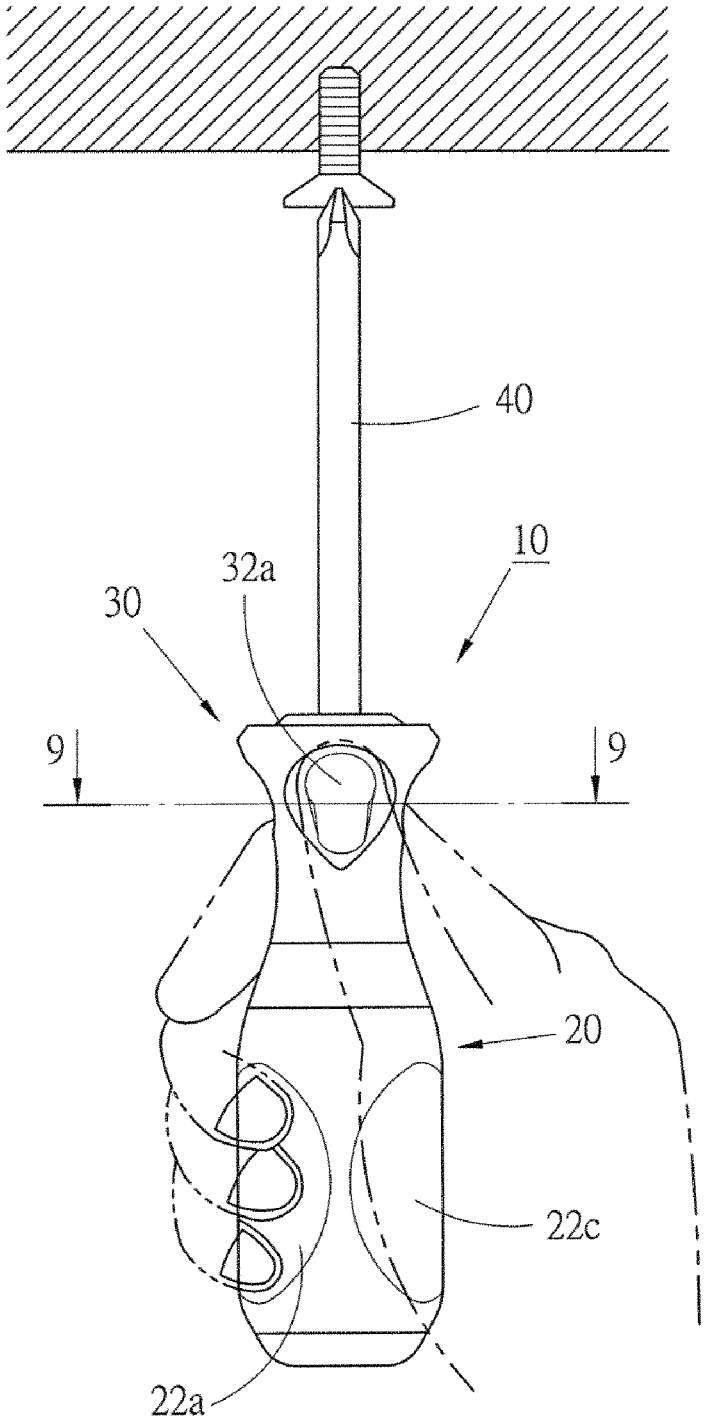
FIG. 8 shows the use of the present invention.

Referring to FIG. 8, the handle 10 is connectable to a screwdriver shank 40 to form a screwdriver. In use, a user's palm and four fingers hold the grip section 20 with the thumb pressing against an abutment region 32 so that a firm holding is achieved. Accordingly, when holding the handle, the user has more force application points to facilitate operation.

FIG. 9 illustrates a holding range of a user's hand according to FIG. 8. The user's thumb presses against the abutment region 32*a* with the palm holding the grip section 20, and the other fingers are positioned on the grip region 22*a*. The holding range A is an arc of 300 degrees on the basis of the centers of the grip region 22*a* and the abutment region 32*a*.

Figure 10:
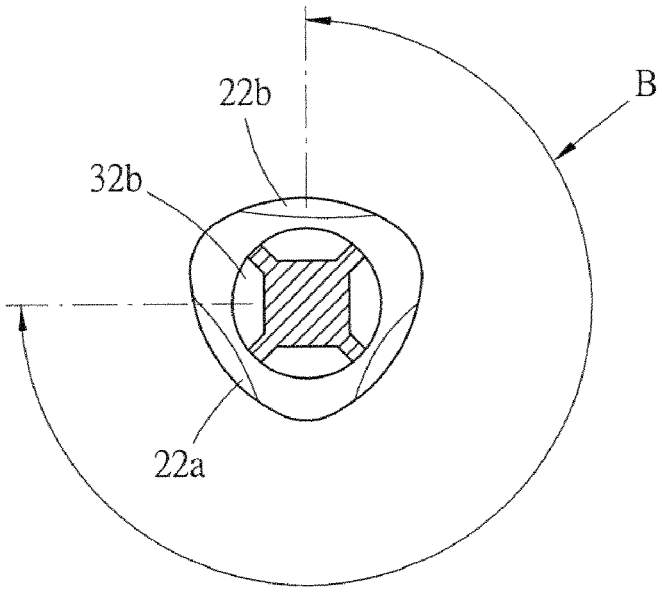
FIGS. 10 to 13 are sectional views according to FIG. 9, showing different holding ranges provided by the first embodiment of the handle of the present invention.
Figure 11:
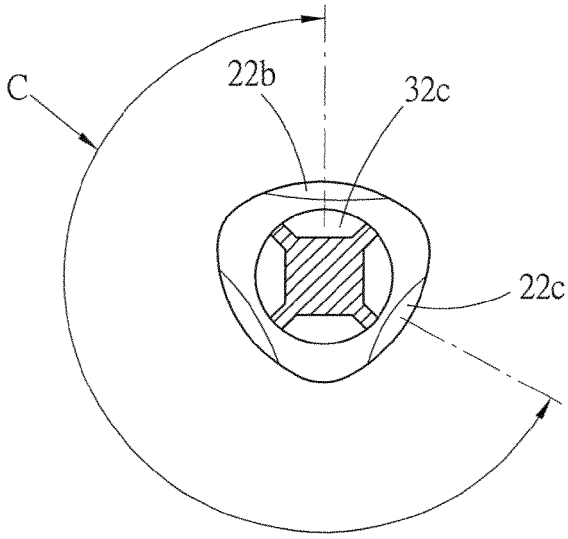
Figure 12:
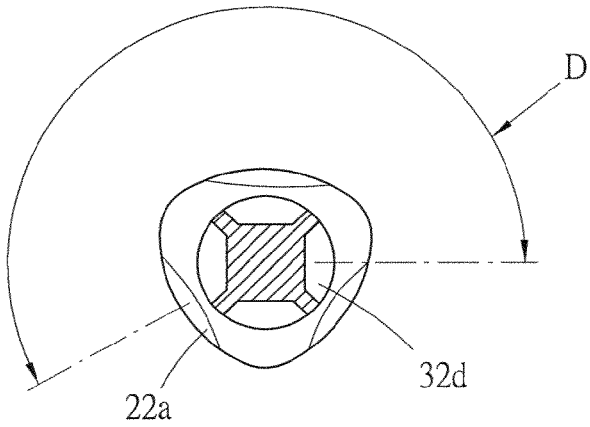
Figure 13:
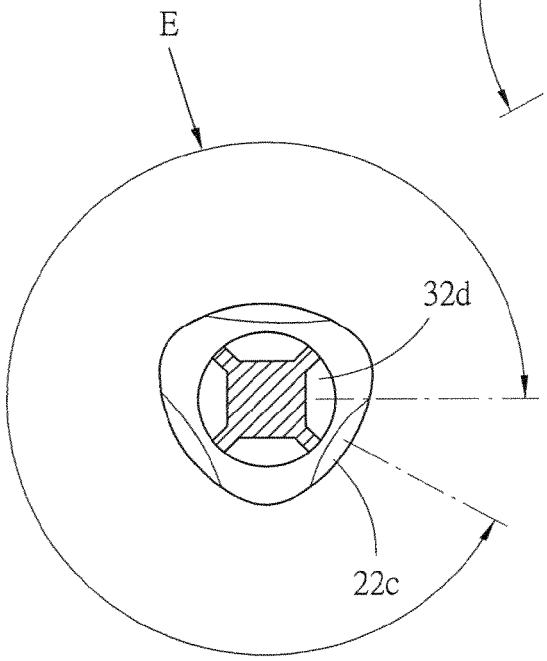

Referring to FIG. 10, when the thumb presses against the abutment region 32*b* with the other fingers positioned on the grip region 22*b*, the holding range B is an arc of 270 degrees. In the case that the thumb presses against the abutment region 32*c* with the other fingers positioned on the grip region 22*c* as shown in FIG. 11, the holding range C is an arc of 240 degrees. In the case that the thumb presses against the abutment region 32*c* with the other fingers positioned on the grip region 22*b*, the holding range is an arc of 360 degrees. Alternatively, as shown in FIG. 12, in the case that the thumb presses against the abutment region 32*d* with the other fingers positioned on the grip region 22*a*, the holding range D is an arc of 210 degrees. As shown in FIG. 13, in the case that the thumb presses against the abutment region 32*d* with the other fingers positioned on the grip region 22*c*, the holding range E is an arc of 330 degrees.

It can be known from the above that by means of the asymmetrical configuration, the handle provides many different holding ranges of different lengths of arcs. Therefore, a user can choose a most suitable position to hold the handle according to the size of his/her palm. In this case, the user can hold and exert force onto the handle in a best manner to achieve optimal force application effect.

Figure 14:
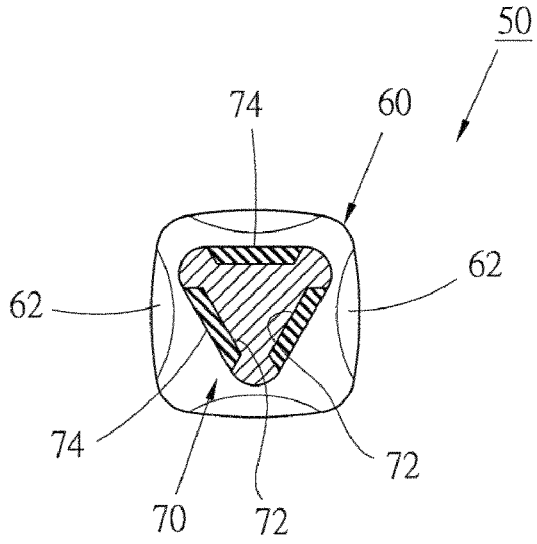
FIG. 14 is a sectional view of a second embodiment of the handle of the present invention.

FIG. 14 is a sectional view of a second embodiment of the handle 50 of the present invention, which is taken along the same line as FIG. 9.

The grip section 60 of the handle has a substantially quadrangular cross-section to provide four grip regions 62. The neck section 70 of the handle has a substantially triangular cross-section to provide three abutment regions 72. The grip regions 62 and the grip regions 72 are also asymmetrically arranged to form an asymmetrical configuration so as to provide many different holding ranges.

Moreover, in each abutment region 72 is disposed a material 74, which is different from and softer than the material of the handle. In this case, the abutment region has a smooth and flexible surface flush with the surface of the neck section. Similarly, a softer material can be disposed in each grip region 62 to provide flexible surface for easy holding.

Figure 15:
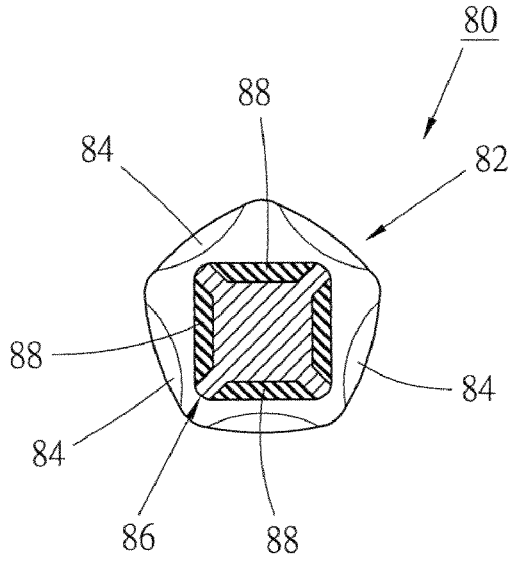
FIG. 15 is a sectional view of a third embodiment of the handle of the present invention.

FIG. 15 is a sectional view of a third embodiment of the handle 80 of the present invention, in which the grip section 82 has a substantially pentagonal cross-section to provide five grip regions 84. The neck section 86 has a substantially quadrangular cross-section to provide four abutment regions 88. The abutment regions and the grip regions are also asymmetrically arranged to form an asymmetrical configuration. Soft materials can be also filled in the abutment regions and grip regions.

In this embodiment, holding ranges of an arc of 360 degrees, an arc of 288 degrees, an arc of 216 degrees, an arc of 306 degrees, an arc of 234 degrees, an arc of 324 degrees, an arc of 252 degrees, an arc of 342 degrees, an arc of 270 degrees and an arc of 198 degrees are provided.

Figure 16:
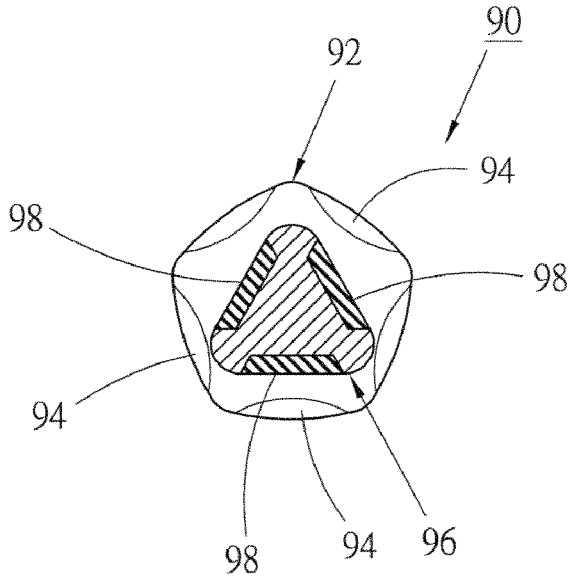
FIG. 16 is a sectional view of a fourth embodiment of the handle of the present invention.
Figure 17:
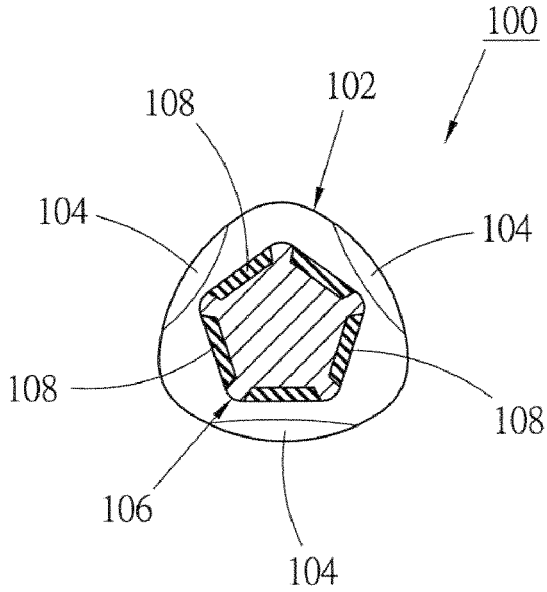
FIG. 17 is a sectional view of a fifth embodiment of the handle of the present invention.

Alternatively, the present invention can have an odd number of grip regions and an odd number of abutment regions in asymmetrical relationship with each other. As shown in FIG. 16, the grip section 92 of the handle 90 has five grip regions 94 formed on the circumference of the grip section 92. The neck section 96 has three abutment regions 98. Still alternatively, as shown in FIG. 17, the grip section 102 of the handle 100 has three grip regions 104 formed on the circumference of the grip section 102. The neck section 106 has five abutment regions 108 formed on the circumference of the neck section 106. Accordingly, the handle can provide many different holding ranges of different lengths of arcs.

According to the above arrangement, the grip regions and the abutment regions are irregularly asymmetrically arranged, whereby the handle can provide many different holding ranges for different users to choose their most suitable positions to hold the handle with best holding effect.

Preferably, the number of the abutment regions of the present invention is no more than six, whereby each abutment region has a sufficient width for the thumb to press against the abutment region.

The above embodiments are only used to illustrate the present invention, not intended to limit the scope thereof. Many modifications of the above embodiments can be made without departing from the spirit of the present invention.

What is claimed is:

1. A handle with asymmetrical configuration, the handle having a grip section and a neck section connected with a top end of the grip section; the handle includes:

multiple grip regions adapted to be pressed by a user's thumb, being disposed on a circumference of the grip section at intervals; and multiple abutment regions adapted to be pressed by a user's palm, being disposed on a circumference of the neck section at intervals; wherein:

there is an odd number of grip regions and there is an even number of abutment regions, the difference between the number of the grip regions and the number of the abutment regions being one, the grip regions and the abutment regions being asymmetrically arranged, whereby the handle provides many different holding ranges.

2. The handle as claimed in claim 1, wherein the number of the grip regions is three, while the number of the abutment regions is four.

3. The handle as claimed in claim 1, wherein the number of the grip regions is five, while the number of the abutment regions is four.

4. The handle as claimed in claim 1, wherein each the abutment region is a recess.

5. The handle as claimed in claim 1, wherein each of the grip regions and/or each of the abutment regions has a surface softer than that of the remaining portion of the handle.

6. The handle as claimed in claim 1, wherein each the abutment region has a surface flush with the surface of the neck section.

7. A handle with asymmetrical configuration, the handle having a grip section and a neck section connected with a top end of the grip section; the handle includes:

multiple grip regions adapted to be pressed by a user's thumb, being disposed on a circumference of the grip section at intervals; and multiple abutment regions adapted to be pressed by a user's palm, being disposed on a circumference of the neck section at intervals; wherein:

there is an even number of grip regions and there is an odd number of abutment regions, the difference between the number of the grip regions and the number of the abutment regions being one, the grip regions and the abutment regions being asymmetrically arranged.

8. The handle as claimed in claim 7, wherein the number of the grip regions is four, while the number of the abutment regions is three.

9. The handle as claimed in claim 7, wherein the number of the grip regions is four, while the number of the abutment regions is five.

10. The handle as claimed in claim 7, wherein each the abutment region is a recess.

11. The handle as claimed in claim 1, wherein each of the grip regions and/or each of the abutment regions has a surface softer than that of the remaining portion of the handle.

12. The handle as claimed in claim 7, wherein each the abutment region has a surface flush with the surface of the neck section.

13. A handle with asymmetrical configuration, the handle having a grip section and a neck section connected with a top end of the grip section; the handle includes:

multiple grip regions adapted to be pressed by a user's thumb, being disposed on a circumference of the grip section at intervals; and multiple abutment regions adapted to be pressed by a user's palm, being disposed on a circumference of the neck section at intervals; wherein:

there is an odd number of grip regions and there is an odd number of abutment regions, the difference between the number of the grip regions and the number of the abutment regions being two, the grip regions and the abutment regions being asymmetrically arranged.

14. The handle as claimed in claim 13, wherein the number of the grip regions is three, while the number of the abutment regions is five.

15. The handle as claimed in claim 13, wherein the number of the grip regions is five, while the number of the abutment regions is three.

16. The handle as claimed in claim 13, wherein each abutment region is a recess.

17. The handle as claimed in claim 1, wherein each of the grip regions and/or each of the abutment regions has a surface softer than that of the remaining portion of the handle.

* * * * *